US005823464A

United States Patent [19]

Bohn et al.

[11] Patent Number: 5,823,464

[45] Date of Patent: Oct. 20, 1998

[54] DEVICE FOR GUIDING PLY WEBS OF PAPER OR THE LIKE

[75] Inventors: Martin Bohn, Reutlingen; Wolfgang Scheller, Oberpleichfeld, both of Germany

[73] Assignee: bielomatik Leuze GmbH & Co., Germany

[21] Appl. No.: 862,287

[22] Filed: May 23, 1997

[30] Foreign Application Priority Data

May 23, 1996 [DE] Germany ..... 196 20 714.2

[51] Int. Cl.[6] ..... B65H 23/32; B65H 20/00

[52] U.S. Cl. ..... 242/615.21; 226/189

[58] Field of Search ..... 242/615.2; 226/189, 226/21; 270/52.07, 52.08

[56] References Cited

U.S. PATENT DOCUMENTS

| | | | |
|---|---|---|---|
| 818,655 | 4/1906 | Balze | 270/52.08 |
| 2,900,934 | 8/1959 | Judelson | 242/615.21 X |
| 3,095,131 | 6/1963 | Robertson et al. | 226/21 X |
| 3,298,581 | 1/1967 | Huck | 226/2 |
| 3,373,288 | 3/1968 | Otepka et al. | 226/21 X |
| 3,512,770 | 5/1970 | Schuffenhauer | 270/52 |
| 3,912,143 | 10/1975 | Miller et al. | 226/21 X |
| 4,017,897 | 4/1977 | Blanding | 360/85 |
| 4,342,412 | 8/1982 | Lorenz et al. | 226/21 |
| 4,453,659 | 6/1984 | Torpey | 226/21 |
| 4,533,130 | 8/1985 | Suter | 270/41 |
| 4,687,125 | 8/1987 | Hashimoto et al. | 226/21 |
| 4,836,744 | 6/1989 | Karl et al. | 425/72.1 |
| 5,016,801 | 5/1991 | Gilat et al. . | |
| 5,480,499 | 1/1996 | Wangerin et al. | 148/657 |
| 5,558,263 | 9/1996 | Long | 226/114 |

FOREIGN PATENT DOCUMENTS

| | | |
|---|---|---|
| 949 169 C | 9/1956 | Germany . |
| 26 38 022 A1 | 2/1978 | Germany . |
| 31 03 261 C2 | 8/1982 | Germany . |
| 38 16 900 C1 | 11/1989 | Germany . |
| 39 19 403 C1 | 4/1990 | Germany . |
| 195 39 693 A | 7/1996 | Germany . |
| 130 0011 | 1/1971 | United Kingdom . |

*Primary Examiner*—Michael Mansen
*Attorney, Agent, or Firm*—Quarles & Brady

[57] ABSTRACT

A web layer (2) is deflected on conical deflectors (31, 34) in laterally opposite directions, thereby permitting lateral but parallel displacement of the downstream web section (10) with respect ot the upstream web section (6) at low hight extension of the device (1) and at small deflector angles. The deflectors (31, 34) can be separately positionally adjusted in a tumbling motion and are fixed to a support (14) with cardan joint (54).

31 Claims, 3 Drawing Sheets

DEVICE FOR GUIDING PLY WEBS OF PAPER OR THE LIKE

TECHNICAL FIELD AND BACKGROUND OF THE INVENTION

The invention relates to a device for guiding ply webs formed by sheet or film material. The ply web may consist of a paper-like substrate as well as a two-ply or multi-ply arrangement of single plies directly sandwiched in sheet-contact by folding or the like.

In guiding such webs or single plies these are expediently exposed to a permanent tensile stress in the running direction, this tensile stress being constant over the width and length of the web. Furthermore, the web is deflected transversely via one or more deflector bends and the deflected bend restretched directly on leaving the deflection. It may be of advantage in guiding when the web is guided in web sections oriented offset from each other laterally or slanted relative to each other as regards their running direction, for example, to input the web in a first orientation into the device and to output it in a second orientation parallel but offset laterally thereto, as a result of which two webs input juxtaposed in the same plane are located sandwiched above or on each other coincidently as of the output. This is expedient when the sandwiched ply webs are subdivided by cross cuts into ply units and then enveloped as a letter of two or more sheets, each folded individually. Each ply unit may be provided three-ply z-shaped with two parallel longitudinal folds located parallel to the running direction.

For the aforementioned guidance relatively much room or a long guide lane is needed when all deflector bends are partly cylindrical. Furthermore, a deflection having a small deflection radius or involving an angle of an arc exceeding 90° or at least 100° may result in crinkling of individual plies, especially when a multiply web of letter paper is involved.

OBJECTS OF THE INVENTION

The invention is based on the object of defining a device which avoids the drawbacks of known embodiments or of the kind described and which, more particularly, ensures a relatively large lateral displacement of the ply web parallel to its plane over a short running section and/or involving deflector bends of less than 180°.

SUMMARY OF THE INVENTIONS

In accordance with the invention means are provided to deflect the ply web within one or more deflector bends laterally parallel to the ply plane so that the web section leaving the deflector bend runs not only transversely to the ply plane but also parallel to the ply plane slanted relative to the incoming web section. Such a deflector bend may form the web input of the device and/or the web output thereof and further deflector bends may be provided inbetween.

Irrespective of the configuration described at least one deflector bend or all deflector bends each extends within the device over an angle of an arc of less than 120° or 90° so that each results in deflections having a flank angle of more than 60° or at least 90°, more particularly exclusively obtusely angled deflections having a flank angle of at least 100° or 110° and maximally 160° or 125°. All angles of deflection may be roughly the same.

At least one web section may be twisted over the free distance between two deflections directly in sequence like a spiral, for example, by the axes of deflection of these two deflections being located at an acute angle skew to each other when viewing this web section or both directly adjoining web sections from above. Expediently, between the ends of the run of the device only three web sections may be provided angularly extending juxtaposed, namely one in each case adjoining the web input or web output via a deflector bend and a flat web section adjoining the two aforementioned web sections via deflector bends.

In accordance with the invention at least one deflection features differing deflection radii, for example, conical in shape. At least one deflection may be conical at an acute angle. Advantageously, such deflections form the ends of the run, namely the web input and the web output. These two deflections may be countertapered so that the incoming and outgoing web sections, as viewed from above, run in parallel directions or are located in parallel planes, but mutually laterally offset. A web section located inbetween may be located in a plane parallel to the two aforementioned web sections and transversely offset with respect thereto or have a slanting running direction.

Expediently the axis of each deflection is continuously adjustable in all three coordinate directions in space at right angles to each other and also slantingly adjustable to any degree relative to the corresponding three planes in space. These directions or planes may be located parallel to the running direction or the plane of each web section and/or at right angles thereto.

One particularly advantagous aspect consists of two or more or all deflections of the device also being mutually continuously adjustable in at least one of the cited directions. For example, the deflections may be mutually swivelled about an axis located transversely to at least one web section. Furthermore, the deflections may be adjustable backwards and forwards in one direction likewise located transversely or at right angles to at least one web section. Expediently, all deflections are connected via a single column stanchion to a fixed device base located by its swivel axis between the ends of the run or nearer to the web input than to the web output. As viewed axially the swivel axis is located expediently in the region of the output contact point of a deflection following the web input or in the region of the input contact point of a deflection located upstream of the web output.

These and further features are evident from the claims as well as from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

Example embodiments of the invention are explained in more detail in the following and illustrated in the drawings in which.

DETAILED DESCRIPTION

Figure 1:
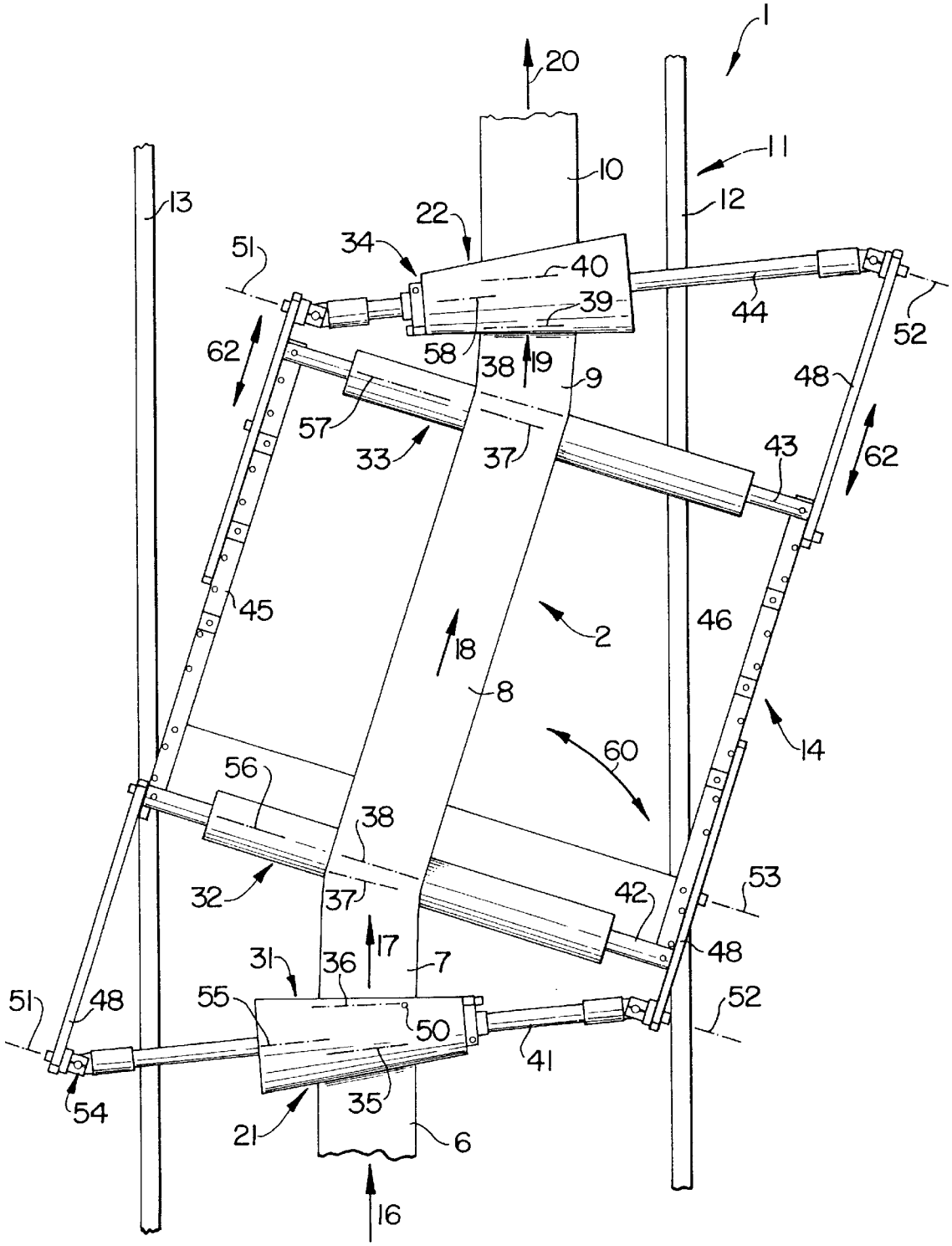
FIG. 1 is a plan view of the device in accordance with the invention.

The device 1 serves to guide a ply web 2 comprising three sandwiched single plies 3 approximately the same in width or differing in width. In the cross-section shown in FIG. 3 the outermost cover plies 3 form free longitudinal edges 5 oriented opposed and like the fold 4 may form the outermost side longitudinal edges of the web 2. Each cover ply is joined via a fold to the adjacent or sole middle ply 3 so that all plies 3 are sandwiched roughly coincidentally. The device 1 guides the ply web so that it forms juxtaposed web sections 6 to 10 at an obtuse angle of 115°, more particularly three flatly extended web sections 6, 8, 10 and two twisted web sections 7, 9 which are twisted about their longitudinal centerline by a few angular degrees of less than 20° or 10°.

Figure 2:
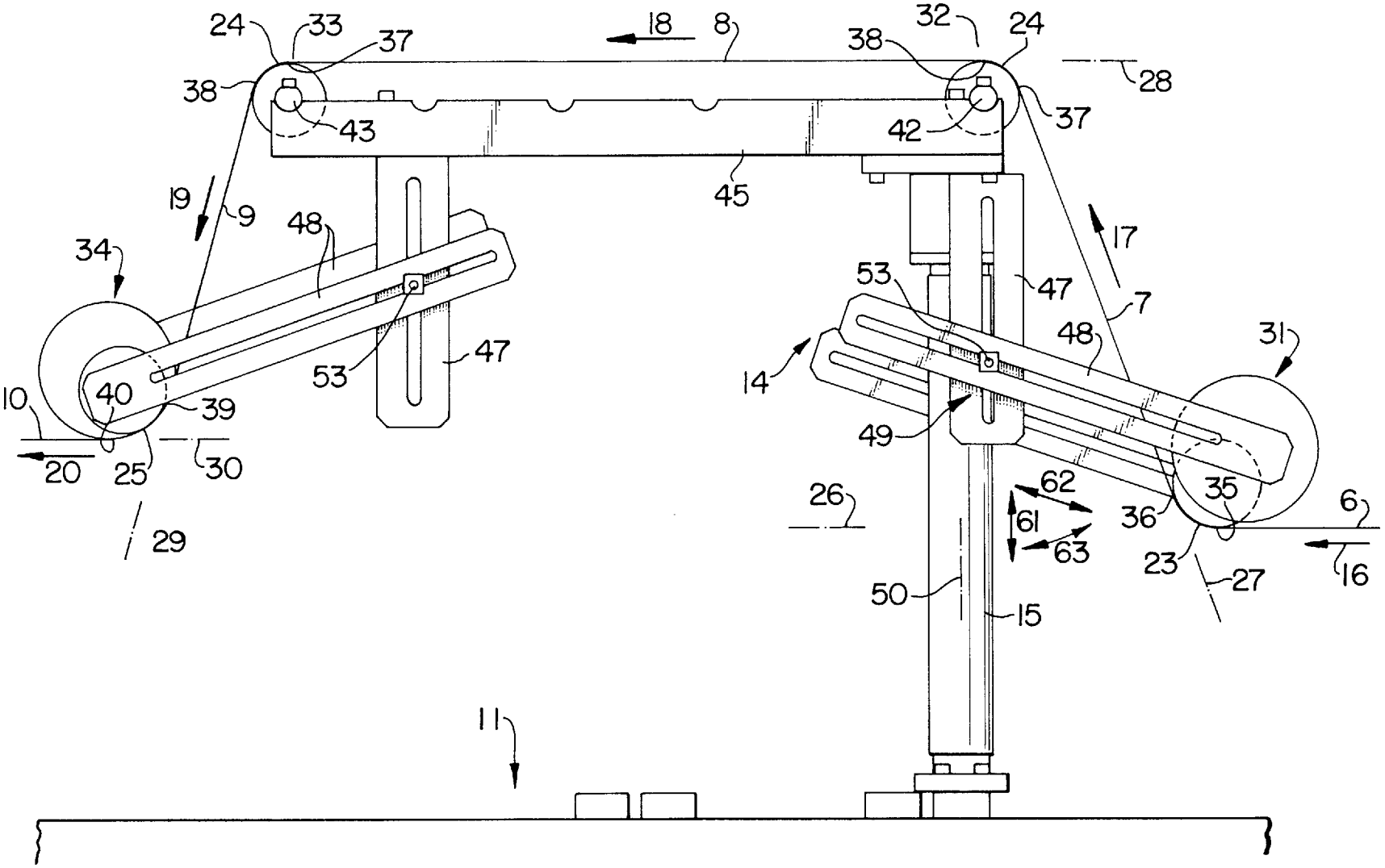
FIG. 2 is a perspective side view of the device as shown in FIG. 1.
Figure 3:
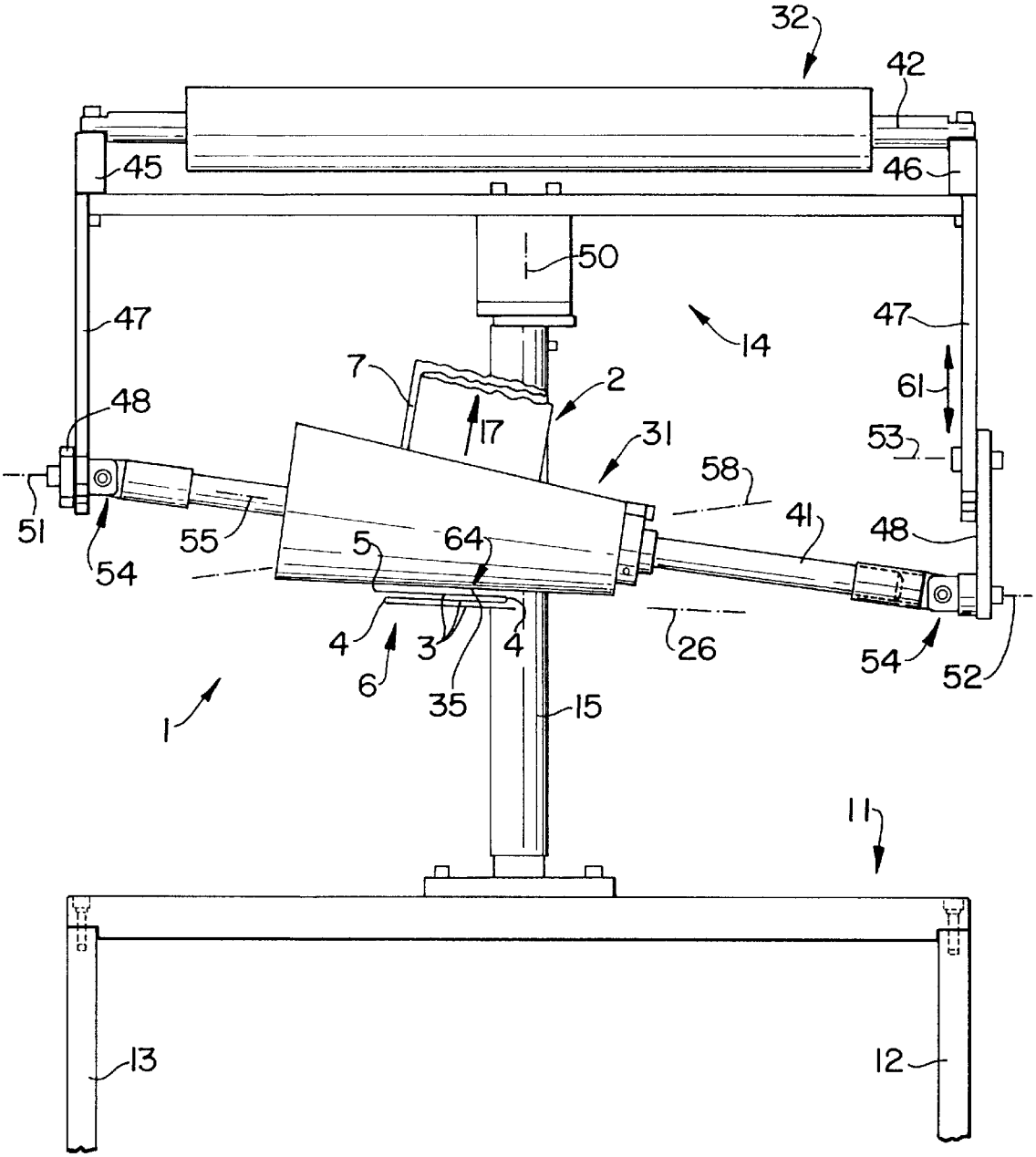
FIG. 3 illustrates the device as shown in FIG. 1 as viewed in the running direction.

Each web section is tensioned over its width during the continual throughout so that the tensile force in all regions of the width is the same. This is achieved by transport and clamping means which guide the z-shape folded ply web 2 frictionally and/or dimensionally positively spaced away upstream and downstream of the device. In running, each web section always comprises one movement component in the main running direction, for example that of sections 6, 8, 10. The web sections 6, 8, 10 run horizontally parallel to each other and are located in horizontal planes, although any other running direction or plane orientation is conceivable. FIG. 1 shows the device in a view at right angles to the horizontal planes whilst FIGS. 2 and 3 show the device 1 in a view parallel to these planes. Reference is made to this special orientation in the following explanations which apply accordingly for any other orientation.

The device 1 comprises a base 11 standing fixed in location on a bed and having two upright side cheeks 12, 13 spaced away from each other. The latter are rigidly connected to each other releasably and interchangeably via transverse cross members. The transverse cross members supported by the upper longitudinal edges of the cheeks 12, 13 carry above the cheeks 12, 13 a main beam 14 of the device 1 secured releasably and interchangeably to the base and transverse cross members respectively so that the complete device 1 can be removed and resecured in place with this main beam. Located on the outer side of the cheek 12 situated on the right in FIG. 1 are drive means for transporting and processing the web, for example gearing, a main shaft and/or motors, all of which are not detained in the following.

However, for its working movement the device 1 requires no drive whatsoever, since such movements are produced solely by the entraining engagement of the web 2. The outer side of the other cheek 13 is the operating control side providing operator access to all parts of the free-standing device 1. The cross members are rail-shaped rods, and the device 1 is located totally above the base 1, 12, 13. The device 1 stands on the base and cross members solely by a single column unit 15 relative to which all other parts of the device are adjustable as well as being non-destructively removable.

The web sections 6 to 10 feature differing running directions 16 to 20 and are located above the base 1. The web 2 first makes contact with the device 1 at a web input 21 by its section incoming parallel to the longitudinal direction of the base 1. Correspondingly, the outgoing web section 10 comes into contact with the device 1 as the last section, and located between these ends of the run 21, 22 are the remaining sections 7 to 9 as well as only four deflector bends 23 to 25 with obtuse angles of an arc. Each section 6 to 10 runs in a different plane 26 to 29 without necessarily being totally flat, but may be twisted about its longitudinal centerline. The planes 26, 28, 30 of the sections 6, 8, 10 are located parallel, but transversely mutually offset, the section 6 being least spaced away from the base 1 and section 8 most spaced away therefrom. The sections 6, 10 having the same running direction 16, 20 are mutually transversely offset laterally but are located between the cheeks 12, 13 as shown in FIG. 1, whereas the running directions 17 to 19 of sections 7 to 9 are located slantingly at an acute angle as seen from above in FIG. 1. The reference planes 27, 29 of the sections 7, 9, which with respect to the former are twisted, are located transversely to the planes 26, 28, 30.

The juxtaposed ends of the sections 6 to 10 are dictated by convex curved deflections 31 to 34 via which the web 2 runs in forming the deflector bends 23 to 25. Each deflection may be formed by a freely rotating roll driven solely by its friction contact with the web 2. Each of the ends of the run 21, 22 is formed by an acute angled conical deflection 31, 34 with a cone angle of maximally 30° or 20°, more particularly approximately 10°.

Both deflections 31, 34 have the same size, are opposingly tapered and feature a minimum radius of curvature which may be larger than the constant radius of curvature of the deflections 32, 33. The identical deflector bends 31, 34 are interchangeable. As shown in FIG. 1 the deflector bends 31, 34 are located axially parallel to each other in an advantagous setting, but are inclined opposingly downwards to their tapered end so that their lowest, axial generating lines are located parallel to or in the corresponding plane 26 and 30 respectively. By tilting relative to this position each section 6 or 10 is twisted and thus its tensile stress may be set constant over its width. At the web input 21 the section 6 contacts the deflection 31 for the first time in this generating line at an input contact point 35 and runs from this point 35 with the deflector bend 23 in close contact with the periphery of the deflection 31 to the output contact point 36 of the deflection 31. At this point 36 the bend 23 translates from the deflection 21 into the section 17.

In the setting shown in FIG. 1 the deflections 31, 34 are slanted slightly relative to the running directions 16, 20 so that the points 35, 36 are located correspondingly slanted and assume an acute angle to each other. Due to this slant the deflection axis and the points 35, 36 are advanced forwards towards the tapered end of the deflection relative to the flared end of the deflection in the running direction 16. The section 7 running tensioned between the deflections 31, 32 without contacting the latter comes into contact with the deflection 32 at the input contact point 37, runs over its complete width correspondingly in close contact with the bend 24 up to the output contact point 38 and translates therefrom into the section 8. The deflections 32, 33 have radii of curvature constant and equal over the fully effective width or length.

As described, the section 8 running tautly tensioned between the deflections 32, 33 free of contact therewith comes up to the deflection 33 at the contact point 37, runs thereon with the bend 24 and leaves it at the contact point 38 as the section 9 which like the section 7 runs without contact to the input contact point 39 of the deflection 34. From here the web runs, as explained relative to the deflection 31, with the bend 25 up to the output contact point 40 from which the section emanates. The contact points 39, 40 as well as the corresponding deflection axis are located, as explained relative to deflection 31, slanted to such a degree that they are advanced towards the flared end of the deflection in the running direction 16 to 20.

As shown in FIG. 1 the two deflections 32, 33 are located parallel in a common axial plane parallel to the planes 26, 28, 30. The deflections 31, 32 or 33, 34 are located, however, at an acute angle closing in the direction of the taper of the deflection 31 and 34 respectively relative to the adjustable deflection 32 and 33 respectively and this angle is larger than the cited axial angles or contact point angles of the deflections 31, 34 relative to the running direction 16, 20. Section 8 runs at right angles to the deflections 32, 33. The web section 23 experiences already from the contact point 35 to the contact point 36 a laterally slanting deflection so that here its running direction laterally departs slanted from its running direction 16 as shown in FIG. 1. In this laterally slanting run the section 7 is guided up to the point 37 so that this point is laterally offset relative to the points 35, 36. The sections 9, 25 run counterwise correspondingly laterally slanted and between the points 39, 40 the same laterally slanted deflection of the section 25 occurs as for the section 23 but counterwise. The lines of contact may be straight or steeply spiral lines.

As shown in FIG. 1 the section 10 runs laterally offset relative to the beam or stanchion 15 so that between the upper side of the base 1 and below the deflections 31 to 34 a further web like web 2 can be transported tautly tensioned through the device 1 in the running direction 16, 20 without contact. At the output 22 the two webs including web 2 are then located coincidently as shown in FIG. 1 so that the web 2 deflected laterally is located correspondingly on the web passing through linearly and can be divided therewith in common by cross cuts into folded, sandwiched single sheets the same in size.

Each deflection 31 to 34 is arranged on a rod or an axle body 41 to 44 and rotatably mounted so that their axes are fixed in operation. In operation the beam 14 forms a frame ridigly connected to the upper end of the stanchion 15, between the parallel web-shaped side frames 45, 46 on which the deflections 31 to 34 are located as shown in FIG. 1. Rigidly connected to these mounting parts 45, 46 are the axes 42, 43 by their ends. Freely protruding from each mounting part or from the frame are further mounting parts 47, 48, to the ends of which the axes 41, 44 are ridigly connected by their ends, separate mounting parts 47, 48 being provided for each of these ends. One mounting arm 47 of each mounting arrangement 47, 48 is rigidly connected to the frame in the region of the associated side part 45, 46 so that it freely protrudes downwards elongated. Secured to this mounting arm 47 transversely is a mounting arm 48 at the free end of which the associated end of the corresponding axis 41, 44 is secured so that the deflection 31 and 34 respectively is supported solely thereby. The mounting ends of the arms 48 for the deflection 31 freely protrude from the direction 16 to 20 and the arms 48 for the deflection 34 in this direction, as a result of which the deflections 31, 34 are located spaced away from the frame upstream, downstream and below thereof.

For adjusting the deflections 31 to 34 in all three directions in space positioning means 49 are provided. Each end of the deflections 31, 34 can be adjusted independently of the other end in all the directions cited so that this deflection 31, 34 executes a nutational positioning movement, the nutation of which can be varied and established in every adjustment. As a result thereof the cited slanted adjustments and inclinations of the def lections 31, 34 are variable. However, all deflections 31 to 34 may also be adjusted mutually, namely in the direction 60 about a positioning axis 50 located at right angles to the planes 26, 28, 30, coincident with the vertical centerline of the stanchion 15, in the middle of the width between the cheeks 12, 13 at right angles to the frame and which may approximately intersect the deflection 31 or the centerline 36, The frame 14 oriented horizontally and parallel to the planes 26, 28, 30 is secured to the upper end of the vertical stanchion 15 only by its end facing the input 21 and protrudes freely from the latter in the direction 16, 18, 20, its mounting parts 45, 46 at right angles to these deflections 32, 33 being located slanted relative to these directions 16, 18, 20 and parallel to the direction 18. This slant can be altered by rotation about the axis 50.

Each of the axis ends 41, 44 is secured to the associated mounting part 48 by a separate mounting hinge or joint 54. This joint, for example a ball, universal or elastomer joint has two joint parts joined together articulatedly, each of which can be varied relative to the other in all cited three dimensional planes. One joint part is rigidly connectable to the associated axis end and the other joint part rigidly connectable to the associated mounting part 48 and non-destructively releasable in each case. At least one joint part of one or both joints 54 of the corresponding axis 41, 44 is axially continuously variable relative to the adjoining component 41, 44 or 48, Between the axis 41, 44 and the associated joint part a sliding guide is expediently non-rotatably connected or a splined shaft engaging a splined sleeve is provided, the spacing between the two joint axes being variable by means of this telescopic shaft.

With deflection 31 as an example, the two joint parts are rigidly secured to the separate mounting parts 48. The joint axes 51, 52 of these two joint parts are oriented parallel to each other and to the deflections 32, 33. These joint axes 51, 52 are further mutually offset in directions parallel to the directions 16 to 20. The joint axes of the two other joint parts rigidly connected to the ends of the axis 41 in the same axis are coincident with the axis 55 of the deflection 31, this applying correspondingly also to the deflection 32 and its axis 58.

Each mounting part 48 itself can be adjusted relative to the frame or the associated mounting part 47 about an positioning axis 53 located in the region of the associated mounting part 47 spaced away from the associated deflection axis 55 and 58 respectively from which the mounting part 48 freely protrudes and which is horizontally oriented parallel to the planes 26, 28, 30 or at right angles or transversely to the directions 17 to 20. The transverse axis 53 may be formed by fastener means such as a clamping bolt with which the two mounting parts 47, 48 can be rigidly connected or tensioned to each other, thus resulting in each end of each deflection 31, 34 being adjustable about the axis 53 in the direction 63, namely transversely to the positioning direction 60, due to the axes 50, 53 being located at right angles to each other.

The mounting part 48 is also separately adjustable transversely to the planes 26, 28, 30 in the direction 61 as well as in its longitudinal direction 62 relative to the associated mounting part 47 and definable by means of the clamping bolt or the like. For this purpose the clamping bolt passes through longitudinal guides, such as slots, in both mounting parts 47, 48, as a result of which the spacing between the planes 26, 28 and 30, 28 respectively as well as the inclination of the section 7 and 9 respectively can be changed at will.

The spacing too, between each pair of adjacent deflections can be varied in the direction 16 to 20, the axes 56, 57 of the deflections 32, 33 always remaining parallel, however. Each deflection 32 or 33 may be varied parallel to the plane 26, 28, 30 or to the direction 18 relative to the beam 14 at right angles to its axis 56, 57, for example by loosening its axial ends, relocating and resecuring them. Instead of such a stepwise adjustment, continuous adjustment is conceivable. The mounting parts 45, 46 comprise at their upper edges centering or fastening cavities in which the axis ends can be inserted and clamped in place by means of diametral bolts or the like. The deflections 31, 34 and 32, 33 respectively are interchangeable together with their axes.

Due to the configuration described the spacing between the planes 26, 28 or 30, 28 may be selected very small, for instance, smaller than the length of the section 8 so that despite a large lateral displacement the device 1 can be configured with a low profile and also short in length. If the web 2, as shown in FIG. 2, is guided so that the single ply 3 adjoining the deflection 31 or 34 points by its longitudinal edge 5 in the direction of the flaring of the deflection, this single ply 3 experiences a transverse force in the direction of the edge 5 which transversely tautens and smooths the single ply 3 correspondingly away from the associated fold 4. As a result thereof tautening means are defined particularly at the deflection 31 which prevent crinkling of the single plies 3. All effects and properties as stated may be provided precisely as described, merely approximately so or substantially as described or strongly deviating therefrom.

I claim:

1. A device for guiding a material web (2) defining a web length extension, a web width extension, a web plane (26 to 30) and longitudinal web sections (6, 10) including a fed section (6) and an offgoing section (10), the fed section (6) defining a first running plane (26) and a first running direction (16), the offgoing section (10) defining a second running plane (30) and a second running direction (20), said device comprising:

a stationary device base (11), deflection means for deflecting the material web (2), said deflection means extending between path ends (21,22) and including a web inlet (21) for receiving the fed section (6) and a web outlet (22) for giving out the offgoing section (10), said deflection means further including between said path ends (21, 22) deflectors, said deflectors (31 to 34) including first and second deflectors (31, 34) for curving the material web (2) transverse to the web plane (26 to 30), said first deflector (31) defining first contact points (35, 36) including a first inlet point (35) for initially contacting the material web (2), a first outlet point (36) for finally contacting the material web (2) and a first deflection arc (23) extending from said first inlet point (35) to said first outlet point (36) and defining a first arc axis (55), said second deflector (34) defining second contact points (39, 40) including a second inlet point (39) for initially contacting the fed section (6), a second outlet point (40) for finally contacting the offgoing section (10) and a second deflection arc (25) extending from said second inlet point (39) to said second outlet point (40) and defining a second arc axis (58), between said first and second deflection arc (23, 25) said deflection means guiding the material web linearly, for directly connecting to each individual contact point of said first and second contact points (35, 36 or 37, 38 or 39, 40) remote from said first and second deflecting arcs (23 to 25) the material web (2) defining connecting sections including the fed section (6) and the offgoing section (10), and transposition means for laterally transposing the offgoing section (10) along said first and second arc axes (55, 58) with respect to the fed section (6), said first deflector (31) defining a first deflecting radius and said second deflector (34) defining a second deflecting radius, wherein at least one of said first and second deflecting radii varies along said first and second arc axes (55,58).

2. The device according to claim 1, wherein said first and second contact points (35 to 40) include a linear point linearly contacting the material web, said linear point being oriented slanted with respect to the web length extension (16 to 20) of the connecting section (6 to 10) extending in a planar manner away from said linear point (35 to 40) and at least one of said first and second deflection arc (23, 25).

3. The device according to claim 1, wherein both said first and second deflecting radii are continuously varying along said first and second arc axes and over the web width extension, said first deflecting radius decreasing counter to said second deflecting radius.

4. The device according to claim 1, wherein both said first and second deflection arcs (23, 25) are conical over an axial extension.

5. The device according to claim 1, wherein between said first and second deflectors (31, 34) at least one additional deflector (32, 33) is provided for deflecting the material web (2) between said first and second deflectors, said additional deflector (32, 33) defining an arc radius which is substantially constant over the web width extension.

6. The device according to claim 5, wherein said at least one additional deflector includes additional deflectors (32, 33) spaced from said first and second deflection arcs (23, 25), said additional deflectors including a second additional deflector and a first additional deflector located closer to said first deflector (31) than said second additional deflector, between said first and second additional deflectors (32, 33) the material web (2) being guided in a plane and longitudinally oriented at an angle with respect to at least one of the incoming and offgoing sections (6, 10).

7. The device according to claim 5, wherein from said inlet point (35 or 37 or 39) to said outlet point (36 or 38 or 40) at least one of said first and second deflection arcs (23 to 25) of at least one of said deflectors (31 to 34) defines a deflection angle of the material web below 90° over the entire web width extension, at least one of said first and second deflecting radii including a smallest radius bigger than said arc radius.

8. The device according to claim 1, wherein said path ends (21, 22) are defined by said first inlet point (35) and said second outlet point respectively, the web length extension of the incoming section (6) and the offgoing section (10) being substantially parallel when seen transverse to the first and second running planes (26, 30).

9. The device according to claim 8, wherein between said first and second deflectors (31, 34) the connecting sections further define a plurality of intermediate web sections (7 to 9), all the intermediate web sections (7 to 9) longitudinally running at angles with respect to the first running direction (16), each of said first and said second deflectors (31, 34) individually including said transposition means for oppositely angularly transposing the material web when seen transverse to said first and second running planes (26, 30).

10. The device according to claim 1, wherein setting means are provided for positionally varying said at least one deflector (31 to 34) with respect to said device base (11) in at least one setting direction (60 to 63) oriented at least one of:

transverse to said first and second arc axes (55 to 58);

transverse to said first and second running planes (26 to 30); and, transverse to said first and second running direction (16 to 20), and parallel to said running plane (26 to 30).

11. The device according to claim 10, wherein from said web inlet (21) up to said web outlet (22) said deflectors include a plurality of individual deflectors (31 to 34) and said transposition means, said setting means being provided for individually displacing most of said individual deflectors (31 to 34), at least one of said first and second deflectors being continuously conical over the web width extension.

12. The device according to claim 10, comprising at least two of said deflectors, said setting means commonly positionally varying said at least two of said deflectors (31 to 34).

13. The device according to claim 10, wherein said setting means commonly positionally vary said path ends (21, 22).

14. The device according to claim 10, wherein between said path ends (21, 22) all said deflectors (31 to 34) are commonly pivotable about a setting axis (50) oriented transverse to said web plane (26 to 30) and said first and second arc axes (55 to 58), said setting axis (50) being located between said path ends (21, 22).

15. The device according to claim 1, further comprising a freely projecting base arm (14) bearing said first and second deflectors, said base arm (14) and said first and second deflectors being positionally variable in common with respect to said device base (11), and at least one of said first and second arc axes (55, 58) being positionally variable with respect to said base arm.

16. The device according to claim 1, wherein at least one of said first and second deflectors (31, 34) includes axially remote deflector ends separately positionally variable with respect to said device base (11).

17. The device according to claim 16, wherein said deflector ends are separately radially positionally variable with respect to said device base, setting means being provided for commonly positionally varying said deflector ends with respect to said device base.

18. The device according to claim 16, wherein at least one of said first and second deflectors (31, 34) is connected to said device base (11) with a universal joint (54).

19. The device according to claim 1, wherein said first deflection arc (23) includes a first transpose arc (23) and said second deflection arc (25) includes a second transpose arc (25) spaced from said first transpose arc (23), each of said first and second transpose arcs (23, 25) being conical for oppositely sidewise transposing the material web (2), between and spaced from said transpose arcs (23, 25) said at least one deflector (31 to 34) including not more than two additional deflectors (32, 33), said deflecting radius of at least one of said additional deflector (32 or 33) being constant.

20. The device according to claim 1, wherein said deflection means connect to said device base (11) via a single column (15) standing transverse to said web plane (26 to 30), said column (15) extending below the fed section (6) and the offgoing section (10) and being angularly surrounded by the material web (2), said first and second deflectors and at least one additional deflector (32, 33) separate from said first and second deflectors (31, 34) being located on top of said column and supported with respect to said device base exclusively by said column (15).

21. The device according to claim 20, wherein said column (15) is located closer to said web inlet (21) than to said web outlet (22).

22. The device according to claim 20, wherein said column (15) centrally defines a support axis (50) oriented transverse to said first and second arc axes (55 to 58), said support axis (50) being located close to and in the vicinity of said arc axis (55) of said deflector (31) including said transposition means.

23. A device for guiding a material web (2) including a fed section (6) and an offgoing section (10) oriented substantially parallel to the fed section when seen in a plan view transverse to the fed section and the offgoing section, said device comprising:

a stationary device base (11);

deflectors (31 to 34) for separately deflecting and sidewise transposing the material web (2) between the fed section (6) and the offgoing section (10) to thereby laterally offset the offgoing section (10) with respect to the fed section (6) when seen in said plan view; and, said deflectors including a first deflector (31) directly connecting to the fed section (6), a second deflector (34) directly connecting to the offgoing section (10) and a third deflector (32, 33) located downstream of said first deflector (31) and upstream of said second deflector (34), at least one of said deflectors (31 to 34) being conical.

24. A device for guiding a material web (2) including a fed section (6) and an offgoing section (10) oriented substantially parallel to the fed section when seen in a plan view transverse to the fed section and the offgoing section, said device comprising:

a stationary device base (11);

deflectors (31 to 34) for separately deflecting and sidewise transposing the material web (2) between the fed section (6) and the offgoing section (10) to thereby laterally offset the offgoing section (10) with respect to the fed section (6) when seen in said plan view;

said deflectors including a first deflector (31) directly connecting to the fed section (6), a second deflector (34) directly connecting to the offgoing section (10) and a third deflector (32, 33) located downstream of said first deflector (31) and upstream of said second deflector (34); and, said deflectors (31 to 34) being commonly positionally variable with respect to said device base (11) and each of said deflectors deflecting the material web (2) only once.

25. The device according to claim 24, wherein said deflectors (31 to 34) are commonly positionally variable about a positioning axis (50) oriented transverse to the fed section (6) and the offgoing section (10).

26. A device for guiding a material web (2) including a fed section (6) and an offgoing section (10) oriented substantially parallel to the fed section when seen in a plan view transverse to the fed section and the offgoing section, said device comprising:

a stationary device base (11);

deflectors (31 to 34) for separately deflecting and sidewise transposing the material web (2) between the fed section (6) and the offgoing section (10) to thereby laterally offset the offgoing section (10) with respect to the fed section (6) when seen in said plan view; and, said deflectors including a first deflector (31) directly connecting to the fed section (6), a second deflector (34) directly connecting to the offgoing section (10) and a third deflector (32, 33) located downstream of said first deflector (31) and upstream of said second deflector (34), each of said deflectors (31 to 34) being separately radially positionally variable with respect to said device base.

27. A device for guiding a material web (2) including a fed section (6) and an offgoing section (10) oriented substantially parallel to the fed section when seen in a plan view transverse to the fed section and the offgoing section, said device comprising:

a stationary device base (11);

deflectors (31 to 34) for separately deflecting and sidewise transposing the material web (2) between the fed section (6) and the offgoing section (10) to thereby laterally offset the offgoing section (10) with respect to the fed section (6) when seen in said plan view;

said deflectors including a first deflector (31) directly connecting to the fed section (6), a second deflector (34) directly connecting to the offgoing section (10) and a third deflector (32, 33) located downstream of said first deflector (31) and upstream of said second deflector (34); and, at least one of said deflectors (31 to 34) including remote deflector ends (54) and each of said deflector ends being separately and individually radially positionally displaceable.

28. A device for guiding a material web (2) including a fed section (6) and an offgoing section (10) oriented substantially parallel to the fed section when seen in a plan view transverse to the fed section and the offgoing section, said device comprising:

a stationary device base (11);

deflectors (31 to 34) for separately deflecting and sidewise transposing the material web (2) between the fed section (6) and the offgoing section (10) to thereby laterally offset the offgoing section (10) with respect to the fed section (6) when seen in said plan view;

said deflectors including a first deflector (31) directly connecting to the fed section (6), a second deflector (34) directly connecting to the offgoing section (10) and a third deflector (32, 33) located downstream of said first deflector (31) and upstream of said second deflector (34); and, bearings mounting said at least one deflector with respect to said device base (11), at least one of said deflectors (31 to 34) being located between said bearings (54), said bearings (54) being axially spaced from each other by a variable bearing spacing.

29. The device according to claim 28, wherein said bearings are universal hinges.

30. The device according to claim 28, wherein said at least one deflector is supported on an axle (41, 44) including said bearings (54), between said bearings said axle defining a variable length extension.

31. A device for guiding a material web (2) including a fed section (6) and an offgoing section (10) oriented substantially parallel to the fed section when seen in a plan view transverse to the fed section and the offgoing section, said device comprising:

a stationary device base (11);

deflectors (31 to 34) for separately deflecting and sidewise transposing the material web (2) between the fed section (6) and the offgoing section (10) to thereby laterally offset the offgoing section (10) with respect to the fed section (6) when seen in said plan view;

said deflectors including a first deflector (31) directly connecting to the fed section (6), a second deflector (34) directly connecting to the offgoing section (10) and a third deflector (32, 33) located downstream of said first deflector (31) and upstream of said second deflector (34); and, said deflectors (31 to 34) including two bigger deflectors (31, 34) each defining a first deflector radius and each of said deflectors including a smaller deflector (32, 33) defining a second deflector radius smaller than said first deflector radius, said smaller deflector (32, 33) being located between said two bigger deflectors (31, 34).

* * * * *